US008408785B2

(12) United States Patent
Hiranuma

(10) Patent No.: US 8,408,785 B2
(45) Date of Patent: Apr. 2, 2013

(54) PORTABLE TIMEPIECE

(75) Inventor: Haruki Hiranuma, Chiba (JP)

(73) Assignee: Seiko Instruments Inc. (JP)

( * ) Notice: Subject to any disclaimer, the term of this patent is extended or adjusted under 35 U.S.C. 154(b) by 178 days.

(21) Appl. No.: 13/065,667

(22) Filed: Mar. 25, 2011

(65) Prior Publication Data

US 2011/0235477 A1 Sep. 29, 2011

(30) Foreign Application Priority Data

Mar. 26, 2010 (JP) ..... 2010-073330

(51) Int. Cl.
*G04B 37/00* (2006.01)

(52) U.S. Cl. ..... 368/291

(58) Field of Classification Search ..... 368/281, 368/286–292, 309
See application file for complete search history.

(56) References Cited

U.S. PATENT DOCUMENTS

| | | | | |
|---|---|---|---|---|
| 2,507,974 | A * | 5/1950 | Georges | 368/288 |
| 3,040,514 | A * | 6/1962 | Hyman | 368/289 |
| 3,535,869 | A * | 10/1970 | Strigini et al. | 368/289 |
| 8,303,168 | B2 * | 11/2012 | Takasawa | 368/280 |
| 2005/0259521 | A1 * | 11/2005 | Ho | 368/281 |

OTHER PUBLICATIONS

Patent Abstracts of Japan, publication No. 05-172956, publication date Jul. 13, 1993.

* cited by examiner

*Primary Examiner* — Edwin A. Leon
(74) *Attorney, Agent, or Firm* — Adams & Wilks

(57) ABSTRACT

To provide a portable timepiece whose vent valve construction is simple, in which the vent valve is not easily erroneously opened, and in which water is not easily allowed to enter the timepiece exterior assembly with the completion of venting.

A wristwatch is equipped with a vent valve mounted to a timepiece exterior assembly. The vent valve is equipped with a pipe, a valve body, a retaining member, and packing formed of a seal material capable of elastic deformation. The timepiece exterior assembly is equipped with the pipe establishing communication between the interior and exterior thereof. The pipe has a valve seat surface, a stopper portion, and a male screw portion. The valve body is equipped with a valve body shaft portion inserted into the pipe, and a valve body head integral with this shaft portion. The valve body head is provided with a female screw portion threadedly engaged with the male screw portion and a plurality of vent holes, with the valve body being axially movable through a change in the mesh engagement of both screw portions. There is mounted to the valve body shaft portion the retaining member moving toward and away from the stopper portion from the interior side of the timepiece exterior assembly. The waterproof packing moving toward and away from the valve seat surface as the valve body moves is mounted to the valve body shaft portion.

6 Claims, 6 Drawing Sheets

PORTABLE TIMEPIECE

BACKGROUND OF THE INVENTION

1. Field of the Invention

The present invention relates to a portable timepiece in which there is a possibility of the inner pressure of a timepiece exterior assembly increasing as in the case, for example, of a diver's watch suitable for saturation diving.

2. Description of the Prior Art

There is known a diver's watch for saturation diving in which, in order to cope with a case where the inner pressure of the timepiece exterior case has become higher than the exterior pressure, the gas inside the timepiece exterior case can be forcibly discharged to the exterior of the case by artificially depressing a button of a vent valve provided in this case (See, for example, JP-A-5-172956).

The vent valve with which the diver's watch is equipped with a stepped hole formed in a case band of the timepiece exterior case, a button, a retaining ring, a coil spring, and packing.

A small diameter hole portion of the stepped hole is open to the inner side of the case band, and a large diameter hole portion of the stepped hole is open to the outer side of the case band. The button has an operating portion fit-engaged with the large diameter hole portion, and a shaft portion extending through the small diameter hole portion. The retaining ring, which prevents detachment of the button from the stepped hole, is connected to the shaft portion within the timepiece exterior case. The coil spring is accommodated in the large diameter hole portion while fitted onto the shaft portion, and urges the button toward the exterior of the case band. The packing is fixed to the shaft portion. In the normal state, in which the button is not pushed in, this packing exhibits interference while in contact with the inner surface of the small diameter hole portion or of a pipe fitted into this hole portion, and, in the state in which the button is pushed in, it is arranged inside the case band and exhibits no interference.

Thus, simultaneously with the pushing-in operation of the button, the packing is moved so as to be detached from the small diameter hole portion of the stepped hole to the interior of the case band, and communication is established between the interior and the exterior of the case band via the stepped hole. As a result, it is possible to discharge the gas inside the timepiece exterior case to the exterior of this case via the stepped hole.

SUMMARY OF THE INVENTION

In the diver' s watch of Patent Document 1, the exhaust button urged toward the exterior of the case band by the force of the coil spring protrudes from the case band, and is held in a state in which it can be pushed in. Thus, if, during diving, the button is erroneously pushed in by a rock or the like, communication is established between the interior and the exterior of the timepiece exterior case, and there is a possibility of water being instantaneously allowed to enter the timepiece exterior case.

Further, in a situation in which the vent valve of the diver' s watch of Patent Document 1 is operated after saturation diving, there is a possibility of water having been accumulated in the large diameter hole portion of the stepped hole, and water adhering to the wet hand of the diver may enter the large diameter hole portion. Further, when performing the vent valve pushing-in operation in rainy whether, it may occur that rain water is allowed to enter the large diameter hole portion. When exhaust operation is performed in such a situation, there may be a fear of the water in the large diameter hole portion being allowed to enter the timepiece exterior case immediately after the completion of the exhaust, with the packing exhibiting no interference.

Further, in the vent valve of the diver' s watch of Patent Document 1, the button is urged by a coil spring having a spring force (urging force) corresponding to the designated pressure of saturation diving. Since a coil spring is thus needed, a rather complicated construction is involved. Thus, the assembly takes time, and involves a rather high cost.

As described above, in the prior-art technique, the construction of the vent valve is rather complicated, and, in addition to the fear of the vent valve being erroneously opened to allow water to enter the case band, there is a fear of water being allowed to enter the case band as the vent is completed.

To solve the above problems, there is provided, in accordance with the present invention, a portable timepiece in which there is mounted inside a timepiece exterior assembly a vent valve allowing gas pressure in the timepiece exterior assembly to escape to the exterior, wherein the vent valve comprises: a pipe provided in the timepiece exterior assembly so as to establish communication between the interior and the exterior of the assembly and having a stopper portion and a male screw portion; a valve body shaft portion inserted into the pipe; a valve body equipped with a valve body shaft portion inserted into the pipe, and a valve body head provided integrally with the shaft portion and having a plurality of vent holes and a female screw portion threadedly engaged with the male screw portion, and movable through a change in the mesh engagement of the male screw portion and the female screw portion; a retaining member mounted to the valve body shaft portion and adapted to move toward and away from the stopper portion from the interior side of the timepiece exterior assembly as the valve body moves; and packing consisting of a seal material capable of elastic deformation and mounted to the valve body shaft portion or the pipe to move toward and away from a valve seat surface provided on the pipe or the valve body shaft portion as the valve body moves.

In the present invention, it is desirable for the vent valve to be provided in the case band portion of the timepiece exterior assembly, it maybe provided at some other place than the case band portion; further, instead of mounting a pipe member separate from the timepiece exterior assembly, the pipe may also be provided by integrally forming a structure corresponding to the pipe member to the case band portion or the like of the timepiece exterior assembly. In the present invention, the stopper portion of the pipe may, for example, be an end surface of the pipe facing the interior of the timepiece exterior assembly, or an end portion of the pipe machined to be of small diameter and facing the interior of the timepiece exterior assembly.

In the present invention, it is desirable for the plurality of vent holes of the valve body head to be provided at equal intervals in the peripheral direction of the valve body head from the viewpoint of improving the outward appearance of the vent valve; however, this should not be construed restrictively. Further, in the present invention, the operation of rotating the valve body can be performed by utilizing protrusions and recesses formed through knurling provided in the outer periphery of the valve body head; apart from this, it is also possible to prepare a dedicated tool that can be inserted into and pulled out of the plurality of vent holes, and to perform the rotating operation by virtue of the tool, with the forward end portion of the tool inserted into a vent hole.

In the present invention, as the retaining member, it is possible to employ, for example, a retaining plate of a larger diameter than the shaft end surface of the valve body shaft portion situated on the interior side of the timepiece exterior assembly and retained by a screw thrust into the valve body shaft portion in a direction orthogonal to the shaft end surface thereof, or a retaining ring such as an E-ring; alternatively, it is also possible to use, as the retaining member, as screw having a head portion of a larger diameter than the shaft end surface of the valve body shaft portion and thrust into the valve body shaft portion in a direction orthogonal to the shaft end surface thereof.

In a case in which the packing is mounted to the valve body shaft portion, the, present invention can be carried out, with the valve seat surface being formed on the inner surface of the pipe; conversely, in a case in which the packing is mounted to the inner surface of the pipe, the present invention can be carried out, with the valve seat surface formed on the valve body shaft portion.

In the normal state of the portable timepiece of the present invention, the vent valve is closed. That is, the valve body is thrust in to a maximum degree while maintaining the threaded-engagement state in which the male screw portion of the pipe and the female screw portion of the valve body are in mesh with each other, so that the packing is held in intimate contact with the valve seat surface, and the retaining member is spaced apart from the stopper portion. When, saturation diving, for example, is conducted in this state, high pressure is exerted from the exterior of the timepiece exterior assembly through the vent holes of the valve body; however, the sealing performance of the vent valve is maintained due to the above-mentioned intimate contact. On the other hand, a seal material permeable gas such as helium gas used in saturation diving permeates through the packing, etc., so that the inner pressure of the timepiece exterior assembly is enhanced.

To vent the inner pressure of the timepiece exterior assembly after saturation diving or the like, the vent valve is opened. That is, the valve body is rotated so as to open the vent valve, and the valve body is moved until the retaining member is engaged with the stopper portion while maintaining the threaded engagement state of the male screw portion and the female screw portion. As a result, the packing is separated from the valve seat surface, so that the gas in the timepiece exterior assembly circulates within the pipe, and is further discharged to the exterior through the vent holes of the valve body.

At the time of this venting, even if water has been allowed to enter, through the vent holes, the downstream portion of the packing with respect to the gas flow, and is accumulated there, this water is discharged to the exterior via the vent holes together with the gas flow discharged as described above, so that, immediately after the venting, it is possible to suppress intrusion of the accumulated water into the interior of the timepiece exterior assembly. Further, even if water is accumulated around the valve body head of the valve body, the pipe and the valve body head are kept continuous with each other by the male screw portion and the female screw portion maintained in the threaded engagement state, so that it is possible to prevent the water around the valve body head from entering the inner side of the vent valve as the venting is completed.

Further, in the portable timepiece of the present invention, even if some object hits the valve body of the vent valve thereof during, for example, diving, the valve body does not move in the axial direction unless this valve body is continuously rotated. Thus, if the valve body inadvertently receives a pushing-in force, there is no fear of the vent valve being opened to allow water enter into the timepiece exterior assembly.

Further, in the vent valve of the portable timepiece of the present invention, the state in which the packing is held in intimate contact with the valve seat surface is maintained by threaded-engagement of the male screw portion of the pipe with the female screw portion of the valve body, so that, for this no coil spring is required for this maintenance, thereby providing a simple construction.

In a preferred mode of the present invention, the packing is held in intimate contact with the valve seat surface, with the valve body screwed in, and, in a state in which the screwing-in of the valve body is loosened, the packing is separated from the valve seat surface.

In this mode of the invention, through screwing-in of the valve body, it is possible to close the vent valve, and, through loosening of the screwing-in of the valve body, the vent valve is opened to allow venting, so that it is further advantageous in that there is no incongruity in operation.

In a preferred mode of the portable timepiece of the present invention, the valve seat surface consists of a tapered surface provided in the inner periphery of the pipe, and the valve seat surface is formed such that the diameter made by this valve seat surface is gradually reduced toward the interior of the timepiece exterior assembly; and the packing is mounted to the valve body shaft portion, and, in a state in which the valve body is screwed in to a maximum degree, the vent holes communicate with an annular space formed between the packing held in intimate contact with the valve seat surface, the valve body head, an inner peripheral surface of the pipe inclusive of the valve seat surface situated between the packing and the valve body head, and a peripheral surface of the valve body shaft portion opposed to this inner peripheral surface.

In this mode of the invention, in the state in which the vent valve is closed, it is possible to enhance the seal performance by utilizing an external pressure such as a water pressure outside the timepiece exterior assembly acting on the packing through the vent holes and a gas pressure. That is, the packing is reduced in diameter while undergoing elastic deformation so as to be pushed in to the smaller diameter portion side of the diameter made by the valve seat surface formed by a tapered surface, so that the packing is more firmly held in intimate contact with the valve body shaft portion, and the packing is more firmly held in intimate contact with the valve seat surface. As a result, it is further advantageous in that it is possible to achieve a further improvement in terms of seal performance as the external pressure is applied.

In a preferred mode of the portable timepiece of the present invention, the vent holes are provided so as to reach the opening of the pipe situated on the outer side of the timepiece exterior assembly in the state in which the valve body has been screwed-in to a maximum degree.

In this mode of the invention, the vent holes of the valve body are positioned so as to be continuous with the opening of the pipe situated on the outer side of the timepiece exterior assembly, so that it is further advantageous in that it is possible to easily discharge to the exterior through the vent holes the water having entered the vent valve via the through holes by virtue of the flow of an exhaust gas accompanying the opening of the vent valve.

In a preferred mode of the portable timepiece of the present invention, the timepiece exterior assembly has a positioning portion, and the valve body head has an engagement portion engaged with the positioning portion to hinder the screwing-in of the valve body toward the interior of the timepiece exterior assembly, maintaining a state in which the packing is held in intimate contact with the valve seat surface.

In this mode of the invention, when the valve body is screwed in so as to close the vent valve, the engagement portion of the valve body head is engaged with the positioning portion of the timepiece exterior assembly, whereby the valve body is stopped at a position where the valve body has been screwed in to a maximum degree. Thus, it is advantageously further possible for the completion of the proper screwing-in of the valve body to be perceived, and to prevent detachment of the packing from the valve seat surface consisting of a tapered surface.

In a preferred mode of the portable timepiece of the present invention, the stopper portion protrudes to the inner side of the pipe in an annular configuration.

In this mode of the invention, the stopper portion functions as an embankment, so that if any remaining water in the vent valve should strive to enter the timepiece exterior assembly immediately after the completion of the venting, it is possible to suppress it through the stopper portion.

According to the present invention, it is possible to provide a portable timepiece in which the construction of a vent valve is simple, in which water is not easily allowed to enter a timepiece exterior assembly if the vent valve is erroneously opened, and in which water is not allowed to enter the timepiece exterior assembly with the completion of venting.

DETAILED DESCRIPTION OF THE PREFERRED EMBODIMENTS

In the following, the first embodiment of the present invention will be described in detail with reference to FIGS. 1 through 4.

Figure 1:
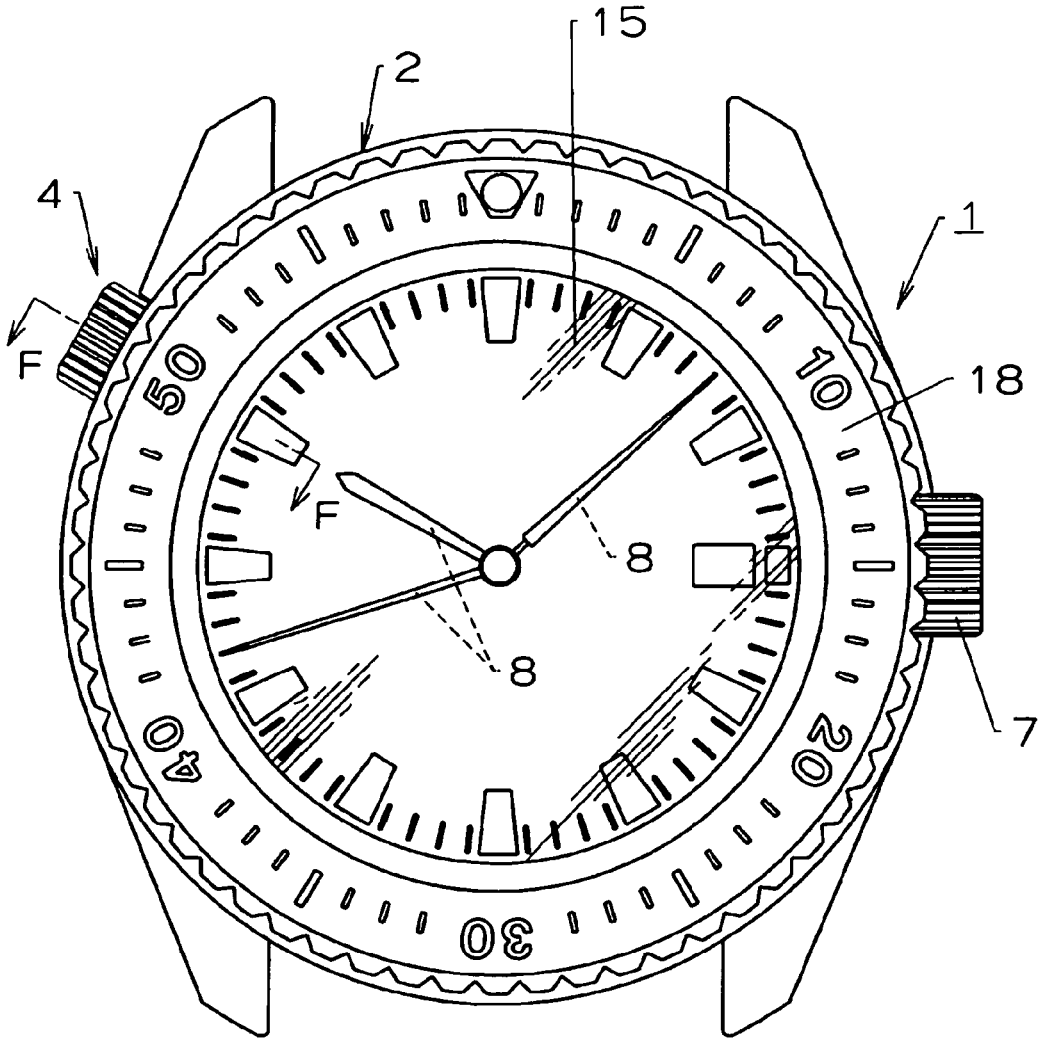
FIG. 1 is a plan view of a wristwatch according to a first embodiment of the present invention.
Figure 2:
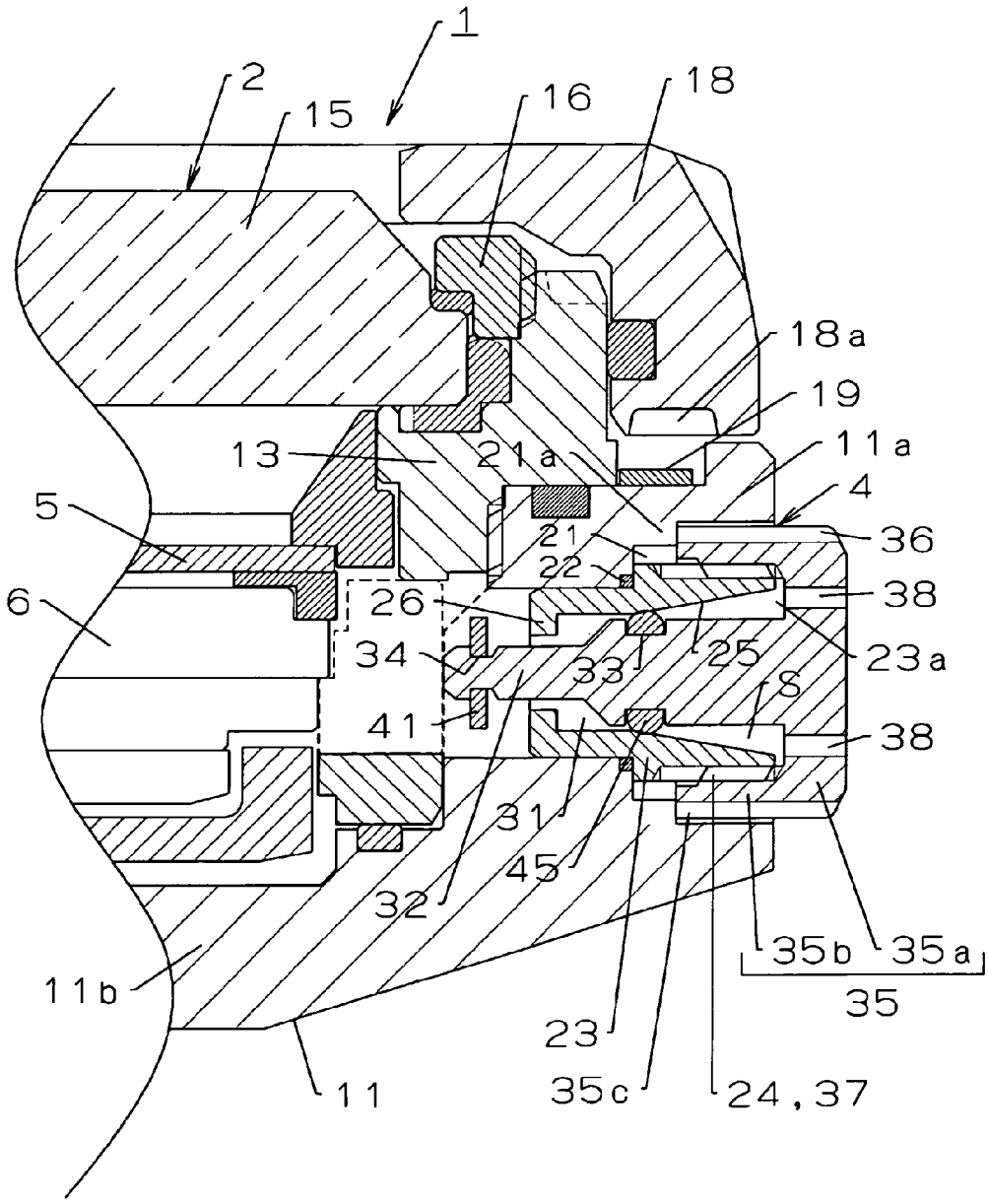
FIG. 2 is a sectional view of the wristwatch of the first embodiment taken along the line F-F of FIG. 1 with a vent valve thereof closed.
Figure 3:
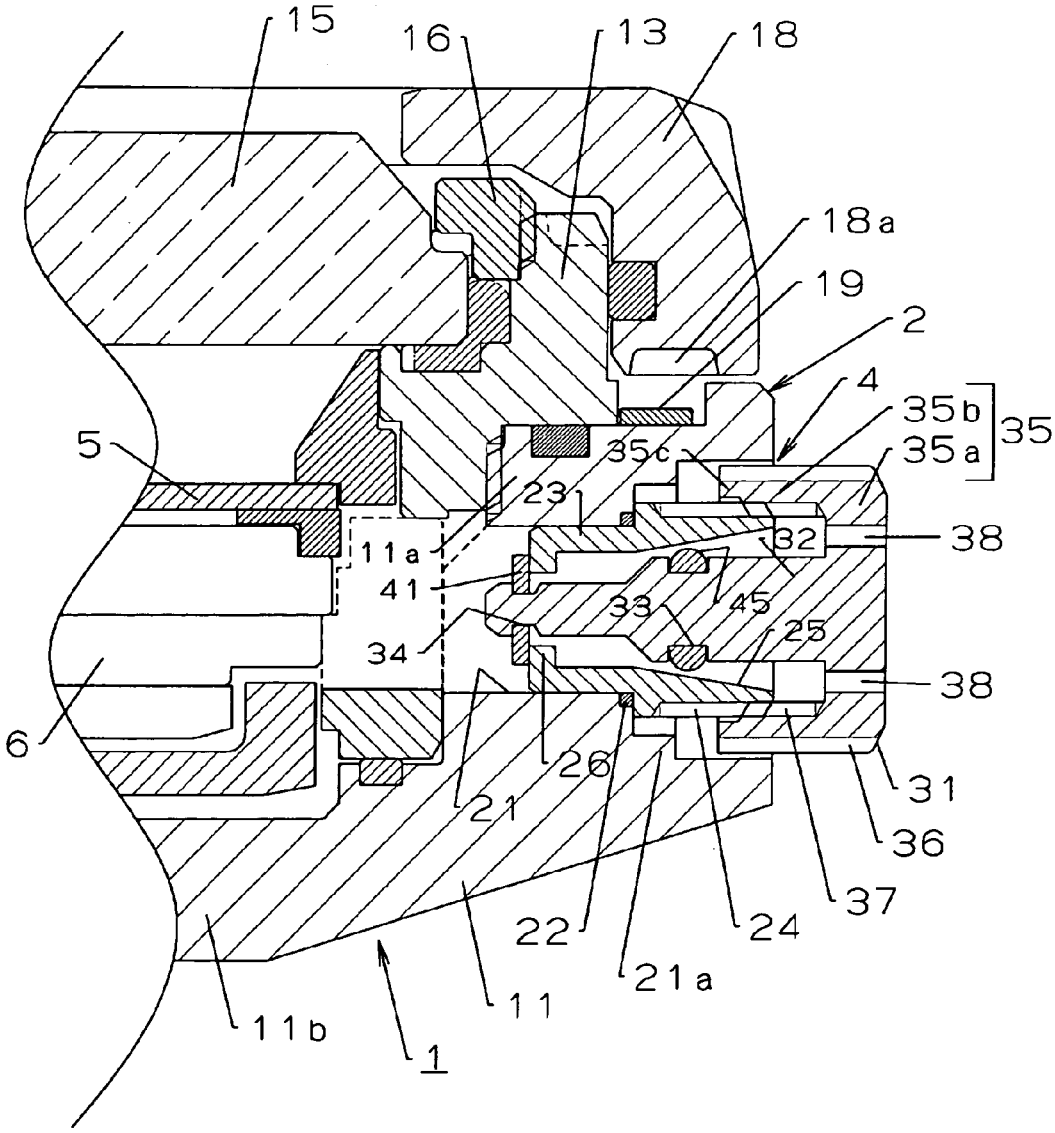
FIG. 3 is a sectional view of the wristwatch of the first embodiment taken along the line F-F of FIG. 1 with the vent valve thereof open.

In FIGS. 1 through 3, numeral 1 indicates a portable timepiece, for example, a wristwatch such as a diver's watch also suitable for saturation diving. The wristwatch 1 is formed by mounting to a timepiece exterior assembly 2 a vent valve 4 for reducing the inner pressure of the timepiece exterior assembly 2. Further, as shown in FIGS. 2 and 3, the timepiece exterior assembly 2 contains a timepiece display plate 5 such as a dial, a movement 6 for driving timepiece display hands 8 shown in FIG. 1, etc.; further, as shown in FIG. 1, a crown 7 is mounted to the peripheral portion of the timepiece exterior assembly 2.

As shown in FIGS. 2 and 3, the timepiece exterior assembly 2 is equipped with a metal exterior member 11 composed of a case band portion 11*a* and a case back portion 11*b* formed integrally with each other, a glass support member 13, and a cover glass 15. It is also possible to employ a timepiece exterior assembly 2 equipped with a construction in which, instead of the exterior member 11, a separate case back corresponding to the case back portion lib is threadedly engaged with a case band corresponding to the case band portion 11*a*.

The glass support member 13 is of a ring-like configuration, and is fixed to the case band portion 11*a* through threaded engagement from the front side thereof. The cover glass 15 is attached to the inner side of the glass support member 13 in a liquid tight fashion, and the back surface thereof is opposed to the timepiece display plate 5. Numeral 16 indicates a glass fixing ring threadedly engaged with the glass support member 13 in order to mount the glass cover 15.

A ring-shaped rotary bezel 18 that can be rotated along the outer periphery of the glass support member 13 is mounted to the timepiece exterior assembly 2. The rotary bezel 18 can be kept at rest at an arbitrary rotating position through engagement of a lock member (not shown) of a lock spring 19 with engagement grooves 18*a* (only one of which is shown) provided on the back surface thereof at a fixed interval along the peripheral direction.

As shown in FIGS. 2 and 3, a pipe mounting hole 21 is provided, for example, in the case band portion 11*a* of the timepiece exterior assembly 2 so as to establish communication between the interior and the exterior of the timepiece exterior assembly 2. The pipe mounting hole 21 consists of a multi-step circular hole; one end thereof, which is of large diameter, is open in the outer surface of the timepiece exterior assembly 2, for example, in the outer surface of the case band portion 11*a*, and the other end thereof, which is of small diameter, is open to the interior of the timepiece exterior assembly 2. A positioning portion 21*a* of the timepiece exterior assembly 2 is formed by an annular step portion that the stepped large diameter hole portion of the pipe mounting hole 21 has in its depth portion.

The vent valve 4 is equipped with a pipe 23, a valve body 31, a retaining member 41, and packing 45.

The pipe 23 is provided, for example, in the case band portion 11*a* of the timepiece exterior assembly 2. More specifically, the pipe 23 consists of a metal pipe, and is inserted into the pipe mounting hole 21 to be fixed to the case band portion 11*a* by a brazing material 22.

The pipe 23 is formed by a large diameter portion and a small diameter portion. The large diameter portion of the pipe 23 is arranged in the stepped large diameter hole portion of the pipe mounting hole 21 communicating with the exterior of the timepiece exterior assembly 2. A male screw portion 24 is formed in the outer periphery of the large diameter portion.

The inner peripheral surface of the large diameter portion of the pipe 23 constitutes a valve seat surface 25. The valve seat surface 25 consists of a tapered surface provided such that its diameter is gradually reduced toward the interior of the timepiece exterior assembly 2. One end on the large diameter side of the valve seat surface 25 reaches the forward end of the large diameter portion of the pipe 23. The other end on the small diameter side of the valve seat surface 25 is continuous with the inner surface of the small diameter portion of the pipe 23. It is also possible for the valve seat surface 25 to be formed without reaching the forward end of the large diameter portion of the pipe 23; in this case, the inner peripheral surface on the forward end portion side of the large diameter portion of the pipe 23 is parallel to the inner surface of the small diameter portion of the pipe 23, and the valve seat surface 25 is provided between them.

The pipe 23 has a stopper portion 26, for example, at the forward end portion of the small diameter portion thereof. The stopper portion 26 consists of a pipe end wall machined so as to be of a still smaller diameter than, for example, the small diameter portion. Thus, the stopper portion 26 protrudes into the interior of the pipe 23 in an annular configuration. The stopper portion 26 faces the interior of the timepiece exterior assembly 2.

The valve body 31 is formed of metal, and is equipped with a valve body shaft portion 32 and a valve body head 35.

The valve body shaft portion 32 is composed of a large diameter shaft portion and a small diameter shaft portion whose outer periphery is circular, and has a length large enough to axially extend through the pipe 23.

The diameter of the large diameter shaft portion of the valve body shaft portion 32 is somewhat smaller than the inner diameter of the small diameter portion of the pipe 23. The large diameter shaft portion is provided with a packing attachment groove 33 open in the outer periphery thereof. The packing attachment groove 33 is formed in an annular configuration so as to make one continuous round in the peripheral direction of the large diameter shaft portion.

The diameter of the small diameter shaft portion of the valve body shaft portion 32 is smaller than the diameter of the opening surrounded by the stopper portion 26. A member attachment groove 34 is formed in the end portion of the small diameter shaft portion on the side opposite to the large diameter shaft portion, that is, in the end portion on the inner portion side of the timepiece exterior assembly 2.

The valve body head 35 is provided integrally on the large diameter shaft portion of the valve body shaft portion 32. The valve body head 35 is formed by an end wall portion 35*a* protruding at right angles from the outer periphery of the valve body shaft portion 32, and an operation cylinder portion 35*b* provided so as to be bent at the end wall portion 35*a*.

Figure 4:
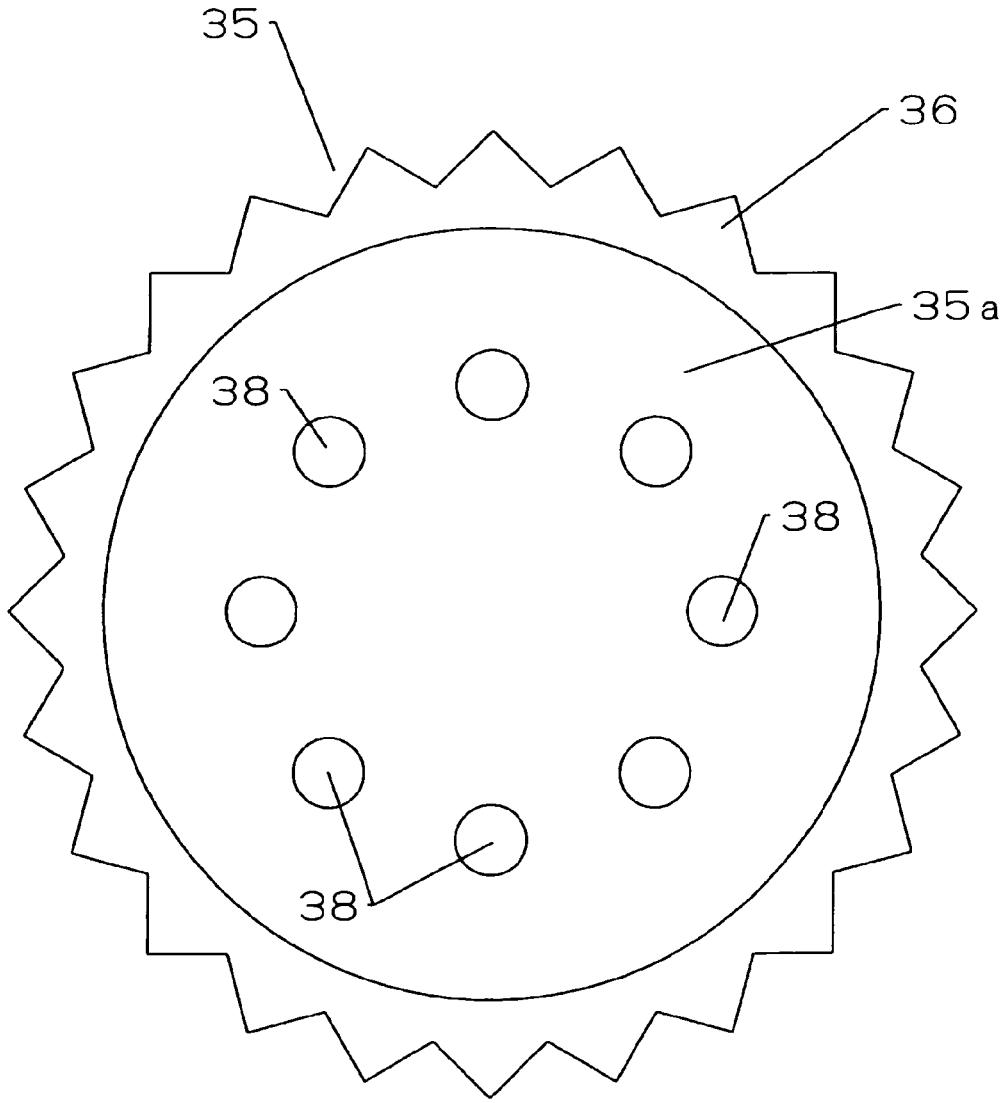
FIG. 4 is a front view of a valve body with which the vent valve of the wristwatch of the first embodiment is equipped.

The operation cylinder portion 35*b* is parallel to the valve body shaft portion 32, and forms an annular groove between itself and the large diameter shaft portion of the valve body shaft portion 32. The case band outer side portion is inserted into the pipe 23 of the annular groove; the operation cylinder portion 35*b* has an anti-slip portion 36 formed by knurling on the outer peripheral surface thereof. As shown in FIG. 4, the anti-slip portion 36 consists of triangular protrusions and recesses successively formed in the peripheral direction. These protrusions and recesses extend in the axial direction of the operation cylinder portion 35*b*. The operation cylinder portion 35*b* has a female screw portion 37 on the inner peripheral surface thereof.

The open end portion, for example, of the operation cylinder portion 35*b* constitutes an engagement portion 35*c* of the valve body head 35. The engagement portion 35*c* can move toward and away from the positioning portion 21*a* as the valve body 31 is moved in the axial direction thereof.

The end wall portion 35*a* has a plurality of vent holes 38. The vent holes 38 are provided between the valve body shaft portion 32 and the operation cylinder portion 35*b*, and, as shown in FIG. 4, are provided at a fixed interval along the peripheral direction of the valve body head 35. This provision of a plurality of vent holes 38 at equal intervals is desirable in that it makes it possible to make the front design of the vent valve 4 a satisfactory one.

The valve body 31 of the above construction is mounted through threaded engagement of the female screw portion 37 thereof with the male screw portion 24 of the pipe 23. Due to this mounting, the valve body shaft portion 32 is inserted into the pipe 23, and is arranged so as to extend through the pipe 23 in the axial direction thereof. Through a change in the mesh engagement of the male screw portion 34 and the female screw portion 37 as the valve body 31 is rotated in the peripheral direction, the valve body 31 can move in the axial direction thereof.

The retaining member 41 is mounted to the forward end portion of the small diameter shaft portion of the valve body shaft portion 32. As the retaining member 41, there is used, for example, a retaining ring such as an E-ring or a C-ring. The retaining ring is not of an annular configuration but has at one end a gap corresponding to a cutout, so that the discharge of gas is possible through this gap. In the retaining member 41, this ventilation property is not indispensable.

The retaining member 41 is mounted to the valve body shaft portion 32 while engaged with the member attachment groove 34, so that it is fixed in position so as to be incapable of moving in the axial direction of the valve body shaft portion 32. The retaining member 41 is situated on the inner side of the case band portion 11*a* with respect to the stopper portion 26, that is, on the inner side of the timepiece exterior assembly 2, and can move toward and away from the stopper portion 26 as the valve body 31 moves.

The packing 45 is formed in a ring-like configuration of a seal material capable of elastic deformation such as synthetic rubber and elastomer. The packing 45 is mounted to the large diameter shaft portion of the valve body shaft portion 32 while fit-engaged with the packing attachment groove 33. The sectional configuration of the outer peripheral portion of the packing 45 is, for example, semi-circular, and this outer peripheral portion protrudes beyond the peripheral surface of the large diameter shaft portion of the valve body shaft portion 32. The packing 45 can move toward and away from the valve seat surface 25 as the valve body 31 moves.

In the normal state of the wristwatch 1, the vent valve 4 is closed as shown in FIG. 2.

That is, the engagement portion 35*c* of the valve body head 35 is in contact with the positioning portion 21*a* of the pipe mounting hole 21, thus regulating the maximum screwing-in depth of the valve body 31 with respect to the pipe 23. In other words, the mesh engagement length of the male screw portion 24 and the female screw portion 37 is maximum. In this state, the end wall portion 35*a* side portion of the valve body head 35 protrudes outwardly from the case band portion 11*a* of the timepiece exterior assembly 2 so that the user can grasp this portion with fingers and rotate the valve body 31. The retaining member 41 mounted to the valve body 31 is spaced apart from the stopper portion 26 of the pipe 23.

And, in the same state, the packing 45 mounted to the valve body 31 is held in intimate contact with the valve seat surface 25 of the pipe 23 while elastically deformed, that is, while exhibiting interference. At the same time, an annular space S is formed between the packing 45, the valve seat surface 25, the peripheral surface of the large diameter shaft portion of the valve body shaft portion 32 opposed to the valve seat surface 25, and the valve body head 35. And, the plurality of vent holes 38 provided in the end wall portion 35*a* facing this annular space S is situated so as to reach the opening 23*a* of the pipe 23 situated on the outer side of the timepiece exterior assembly 2, that is, in the case of the first embodiment, so as to be in close proximity to the opening 23*a* of the maximum diameter made by the tapered valve seat surface 25. Thus, the annular space S communicates with the exterior of the timepiece exterior assembly 2 via the vent holes 38.

In saturation diving, a seal member permeating gas such as helium gas, used in an under-water living quarter, is permeated through the seal material around the cover glass 15, and the packing 45 of the vent valve 4, so that it is possible to enhance the gas pressure inside the timepiece exterior assembly 2.

In this case, the valve seat surface 25 held in intimate contact with the packing 45 consists of a tapered surface, and is gradually reduced in diameter toward the movement 6.

Thus, as the gas pressure in the annular space S is enhanced, the packing 45 is reduced in diameter while undergoing elastic deformation so as to be pushed in toward the small diameter portion side of the valve seat surface 25. As a result, the inner peripheral portion of the packing 45 is held more firmly in intimate contact with the valve body shaft portion 32, and the outer peripheral portion of the packing 45 is held more firmly in intimate contact with the valve seat surface 25. In this way, as the gas pressure in the annular space S is enhanced, it is possible to improve the seal performance by virtue of the vent valve 4, so that the permeation of the helium gas through the packing 45 is mitigated, making it possible to suppress an increase in the inner pressure of the timepiece exterior assembly 2.

For a similar reason, also when the water pressure of the annular space S is enhanced during diving, the seal performance by virtue of the vent valve 4 is improved with that, so that it is possible to reliably suppress intrusion of water such as seawater into the timepiece exterior assembly 2 through the vent valve 4.

Further, as stated above, the valve body head 35 of the valve body 31 of the vent valve 4 protrudes to the exterior of the timepiece exterior assembly 2. Thus, during diving, there is a possibility of some object touching the valve body head 35 to push the valve body 31. In this case, the engagement portion 35*c* of the valve body head 35 is in contact with the positioning portion 21*a* of the timepiece exterior assembly 2, so that there is no fear of the valve body 31 being pushed in. At the same time, unless it is continuously rotated, the valve body 31 does not move in the axial direction, and the rotation of the valve body 31 is not continued simply by pushing the valve body head 35 for a short period of time. Thus, if the valve body head 35 inadvertently receives a force to push it in, the vent valve 4 is not opened, and there is no fear of water being allowed to enter the interior of the timepiece exterior assembly 2.

After the user has surfaced from the under-water living quarter, the user grasps the valve body head 35 to rotate the valve body 31 so as to loosen the threaded engagement portion, whereby it is possible to discharge to the high pressure gas having entered the timepiece exterior assembly 2 to the exterior of the timepiece exterior assembly 2.

That is, through the above-mentioned rotating operation, the valve body 31 is moved so as to protrude to the outer side of the case band portion 11*a*, and, as shown in FIG. 3, the packing 45 is separated from the valve seat surface 25, whereby the vent valve 4 is opened. In this case, when the vent valve 4 has been opened to a certain degree, the retaining member 41 comes into contact with the stopper portion 26 of the pipe 23. As a result, a further rotation to loosen the valve body 31 is hindered, and the state in which the male screw portion 24 of the pipe 23 and the female screw portion 37 of the valve body head 35 are threadedly engaged with each other is maintained.

As the vent valve 4 is opened as described above, the gas inside the timepiece exterior assembly 2 is caused to circulate within the pipe 23 toward the exterior of the case band by the pressure thereof, and, further, passes through the vent holes 38 of the valve body 31 facing the opening 23*a* of the pipe 23 to be discharged to the exterior of the timepiece exterior assembly 2.

At the time of the venting described above, the male screw portion 24 of the pipe 23 and the female screw portion 37 of the valve body head 35 are in the threadedly engaged state as shown in FIG. 3, and the pipe 23 and the valve body head 35 maintain the state in which they form a continuous blocking wall. Thus, even when water has been accumulated around the valve body head 35 of the valve body 31, for example, in the large diameter hole portion of the pipe mounting hole 21, the water around the valve body head 35 is prevented from entering the interior of the vent valve 4 as the venting is completed, and, with that, it is possible to prevent water from entering the interior of the timepiece exterior assembly 2.

During diving, most of the water having entered the annular space S via the vent holes 38 is discharged through the vent holes 36 after the surfacing while effecting replacement of air at the vent holes 38; however, a portion of the water is sometimes allowed to remain in the annular space S. As described above, the vent holes 38 are situated so as to be continuous with the gas outflow side opening 23*a* of the pipe 23. Thus, due to the momentum of the gas discharged as the vent valve 4 is opened as described above, it is possible to discharge the remaining water in the vent hole 4 to the exterior through the vent holes 38 easily and reliably.

Thus, immediately after the venting, there is no fear of water entering the timepiece exterior assembly 2 due to the remaining water mentioned above. Coating the valve seat surface 25 of the pipe 23 with a water-repellent layer of a material exhibiting water repellency such as tetrafluoroethylene, is desirable in that it helps to further enhance the discharge performance for the above-mentioned remaining water.

Further, since the stopper portion 26 constitutes an embankment with respect to the remaining water in the vent valve 4, it is possible to suppress, due to this stopper portion, intrusion of the remaining water into the interior of the timepiece exterior assembly 2 immediately after the venting. Thus, in this respect also, it is possible to more reliably suppress intrusion of water into the timepiece exterior assembly 2.

To restore the valve to the normal state after the venting, rotating operation is performed so as to screw in the valve body 31. As a result, the packing 45 is brought into intimate contact with the valve seat surface 25, and the vent valve 4 is closed. Further, as described above, at the time of venting, as the valve body 31 is rotated so as to be loosened in its screwing-in, the packing 45 is separated from the valve seat surface 25, and the vent valve 4 is opened. In this way, in the vent valve 4 of the above construction, it is possible to close the vent valve 4 through screwing-in of the valve body 31, and it is possible to effect venting by opening the vent valve 4 through loosening of the valve body 31, so that there is no incongruity in operation, which is desirable from the viewpoint of operation.

Further, when closing the vent valve 4 by the above-described procedures, the packing 45 comes into contact with the valve seat surface 25, and, further, immediately after they have been brought into intimate contact with each other to a degree necessary for air/water tightness, the engagement portion 35*c* of the valve body head 35 comes into contact with the positioning portion 21*a* of the pipe mounting hole 21, so that the screwing-in of the valve body 31 is hindered by this engagement. In view of this, as shown in FIG. 2, the valve body 31 is stopped at a position where the valve body 31 has been screwed in to a maximum degree, enabling the user to perceive the completion of the proper screwing-in. At the same time, the packing 45 undergoes further elastic deformation, thus preventing the packing 45 from passing small diameter end portion of the valve seat surface 25 consisting of a tapered surface to be detached from the valve seat surface 25, so that it is possible to retain the packing 45 at the proper sealing position.

Further, in the vent valve 4 of the above construction, the male screw portion 24 of the pipe 23 and the female screw portion 37 of the valve body 31 are threadedly engaged with each other as described above to maintain the state in which the packing 45 is held in intimate contact with the valve seat surface 25, so that, for this maintenance, there is no need to use a coil spring of a spring force (urging force) corresponding to the designated pressure for saturation diving, whereby the number of components is reduced to simplify the construction. Thus, the requisite time and effort for the assembly are reduced, thereby achieving a reduction in cost. At the same time, no spring pressure is exerted on the threaded engagement portion of the male screw portion 24 and the female screw portion 37, so that the wear at the threaded engagement portion is suppressed, thereby making it possible to achieve an improvement in terms of the durability of the vent valve 4.

Further, in the state in which the vent valve 4 is closed, not only is the valve body 31 supported by the seal portion formed by the packing 45 and the valve seat surface 25, but also the valve body 31 is supported by a threaded engagement portion of a larger diameter than this support portion, so that it is possible to support the valve body 31 in a stable state. Similarly, in the state in which the vent valve 4 is closed, although there is no seal portion, the valve body 31 is supported by the threaded engagement portion, so that it is possible to support the valve body 31 without involving any rattling.

Figure 5:
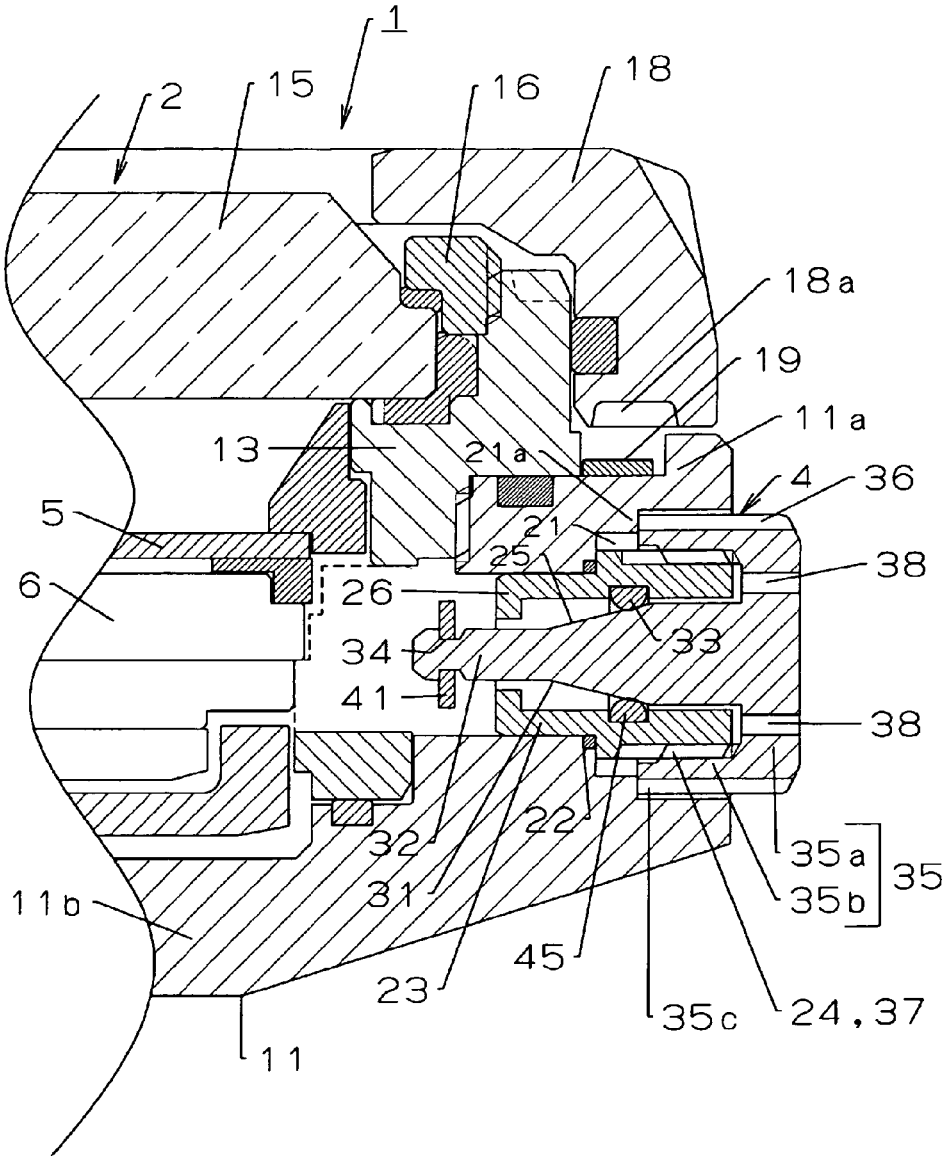
FIG. 5 is a sectional view, corresponding to FIG. 2, of a wristwatch according to a second embodiment of the present invention with a vent valve thereof closed.
Figure 6:
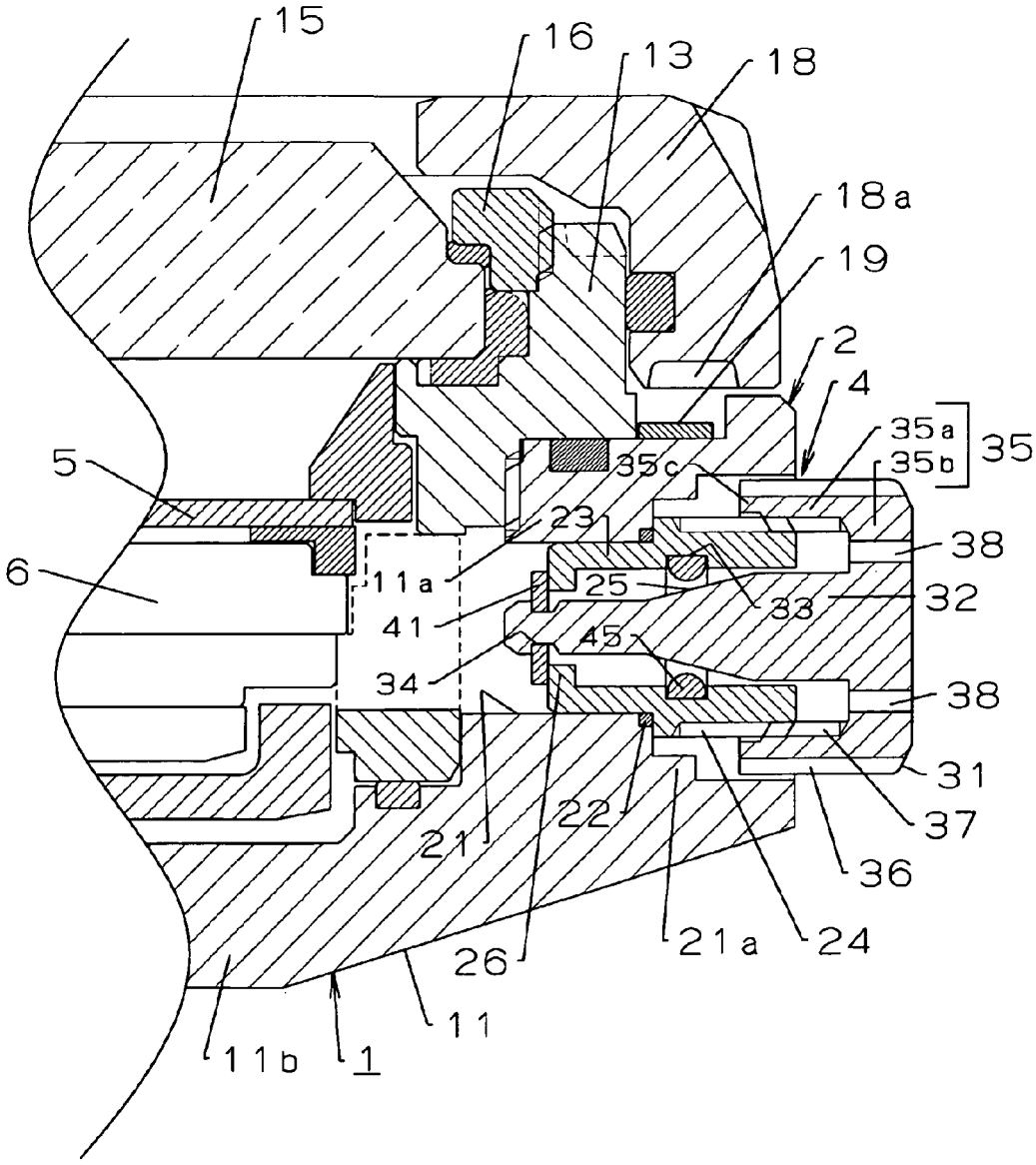
FIG. 6 is a sectional view, corresponding to FIG. 3, of a wristwatch of the second embodiment with the vent valve thereof open.

The second embodiment of the present invention will be described with reference to FIGS. 5 and 6. Except for the matter described below, the second embodiment is the same as the first embodiment. Thus, the components that are of the same construction as those of the first embodiment are indicated by the same reference numerals, and a description thereof will be omitted.

In the second embodiment, the positional relationship between the valve seat surface 25 and the packing 45 is reversed from that of the first embodiment.

That is, the valve seat surface 25 is formed by a tapered surface provided between the large diameter shaft portion and the small diameter shaft portion of the valve shaft portion 32. The nearer to the movement 6 inside the timepiece exterior assembly 2, in other words, the nearer to the small diameter shaft portion side from the large diameter shaft portion, the smaller the diameter of the valve shaft portion 32 formed by the valve seat surface 25.

Further, the portion of the pipe 23 except for the stopper portion 26 thereof is of the same inner diameter, and a packing attachment groove 33 is formed in a longitudinally intermediate portion of this portion. The packing 45 is attached to the packing attachment groove 33. The inner peripheral portion of the packing 45 protrudes from the inner peripheral surface of the above-mentioned portion, and, as the valve body 31 moves in the axial direction, the valve seat surface 25 consisting of a tapered surface moves toward and away for this inner peripheral portion.

In the normal state of the wristwatch 1 of the second embodiment, the vent valve 4 thereof is in a state in which the valve body 31 thereof has been screwed in to a maximum degree. Thus, as shown in FIG. 5, the valve seat surface 25 consisting of a tapered surface is brought into intimate contact with the packing 45, and the vent valve 4 is closed for waterproofing. Further, in the state of FIG. 5, the screwing-in of the valve body 31 is loosened, and the valve body 31 protrudes from the case band portion 11*a* of the timepiece exterior assembly 2 as shown in FIG. 6. In this state, the valve seat surface 25 of the valve body shaft portion 32 is separated from the packing 45 attached to the pipe 23, and the vent valve 4 is open. Thus, the helium gas having entered the timepiece exterior assembly 2 as a result of saturation diving is discharged to the exterior of the timepiece exterior assembly 2 via the vent valve 4 due to the pressure thereof.

Except for the matter described above, this embodiment is the same as the first embodiment. Thus, for the reason already stated in connection with the first embodiment, according to the second embodiment, it is possible to provide a wristwatch 1 in which the vent valve 4 is of a simple construction, and is not easily erroneously opened, and in which water is not easily allowed to enter the timepiece exterior assembly 2 with the completion of the venting operation.

What is claimed is:

1. A portable timepiece in which there is mounted inside a timepiece exterior assembly a vent valve allowing gas pressure in the timepiece exterior assembly to escape to the exterior, wherein the vent valve comprises:

a pipe provided in the timepiece exterior assembly so as to establish communication between the interior and the exterior of the assembly and having a stopper portion and a male screw portion;

a valve body equipped with a valve body shaft portion inserted into the pipe, and a valve body head provided integrally with the shaft portion and having a plurality of vent holes and a female screw portion threadedly engaged with the male screw portion, and movable through a change in the mesh engagement of the male screw portion and the female screw portion;

a retaining member mounted to the valve body shaft portion and adapted to move toward and away from the stopper portion from the interior side of the timepiece exterior assembly as the valve body moves; and packing consisting of a seal material capable of elastic deformation and mounted to the valve body shaft portion or the pipe to move toward and away from a valve seat surface provided on the pipe or the valve body shaft portion as the valve body moves.

2. A portable timepiece according to claim 1, wherein the packing is held in intimate contact with the valve seat surface, with the valve body screwed in, and, in a state in which the screwing-in of the valve body is loosened, the packing is separated from the valve seat surface.

3. A portable timepiece according to claim 1, wherein the valve seat surface consists of a tapered surface provided in the inner periphery of the pipe, and the valve seat surface is formed such that the diameter made by this valve seat surface is gradually reduced toward the interior of the timepiece exterior assembly; and the packing is mounted to the valve body shaft portion, and, in a state in which the valve body is screwed in to a maximum degree, the vent holes communicate with an annular space formed between the packing held in intimate contact with the valve seat surface, the valve body head, an inner peripheral surface of the pipe inclusive of the valve seat surface situated between the packing and the valve body head, and a peripheral surface of the valve body shaft portion opposed to this inner peripheral surface.

4. A portable timepiece according to claim 3, wherein the vent holes are provided so as to reach an opening of the pipe situated on the outer side of the timepiece exterior assembly in the state in which the valve body has been screwed-in to a maximum degree.

5. A portable timepiece according to claim 3, wherein the timepiece exterior assembly has a positioning portion, and the valve body head has an engagement portion engaged with the positioning portion to hinder the screwing-in of the valve body toward the interior of the timepiece exterior assembly, maintaining a state in which the packing is held in intimate contact with the valve seat surface.

6. A portable timepiece according to claim 1, wherein the stopper portion protrudes to the inner side of the pipe in an annular configuration.

* * * * *